US008443906B2

(12) United States Patent
Tessari et al.

(10) Patent No.: US 8,443,906 B2
(45) Date of Patent: May 21, 2013

(54) TOOLS AND METHODS USEFUL WITH WELLBORE REVERSE CIRCULATION

(75) Inventors: Robert M. Tessari, Calgary (CA); Barry J. Tate, Calgary (CA); Tommy M. Warren, Coweta, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 420 days.

(21) Appl. No.: 12/303,844

(22) PCT Filed: Jun. 6, 2007

(86) PCT No.: PCT/CA2007/001009
§ 371 (c)(1),
(2), (4) Date: Feb. 3, 2009

(87) PCT Pub. No.: WO2007/140612
PCT Pub. Date: Dec. 13, 2007

(65) Prior Publication Data

US 2010/0206580 A1 Aug. 19, 2010

Related U.S. Application Data

(60) Provisional application No. 60/804,074, filed on Jun. 6, 2006, provisional application No. 60/862,491, filed on Oct. 23, 2006.

(51) Int. Cl.
*E21B 23/01* (2006.01)

(52) U.S. Cl.
USPC ..... 166/386; 166/383; 166/377; 175/257

(58) Field of Classification Search
USPC ..... 166/250.01, 250.17, 377, 381, 383, 166/386; 175/62, 69, 73, 76, 85, 93, 94, 99, 175/171, 230, 257, 309
See application file for complete search history.

(56) References Cited

U.S. PATENT DOCUMENTS

| | | | | |
|---|---|---|---|---|
| 2,220,554 | A * | 11/1940 | Straatman | 175/247 |
| 5,186,265 | A * | 2/1993 | Henson et al. | 175/107 |
| 5,271,472 | A * | 12/1993 | Leturno | 175/107 |
| 6,923,256 | B2 * | 8/2005 | Parker | 166/242.7 |
| 7,021,382 | B2 * | 4/2006 | Angman et al. | 166/301 |
| 7,152,674 | B2 * | 12/2006 | Bowles | 166/242.6 |
| 2004/0026126 | A1 * | 2/2004 | Angman | 175/57 |
| 2007/0051538 | A1 * | 3/2007 | Angman et al. | 175/57 |

OTHER PUBLICATIONS

Drilling Liner Technology for Depleted Reservoir, C. Vogt, SPE and F. Makohl, SPE, Baker Hughes INTEQ; P. Suwamo, SPE and B. Quitzau, SPE, Mobil Oil Indonesia—SPE 36827—pp. 127-132.

* cited by examiner

*Primary Examiner* — Brad Harcourt
(74) *Attorney, Agent, or Firm* — Osha • Liang LLP

(57) ABSTRACT

A method for reverse circulating a tool upwardly through a wellbore, the method including: providing a manipulator tool including an upper end and a lower end, conveying the manipulator tool down hole to a position adjacent a downhole tool, using the manipulator tool to manipulate the downhole tool, and reversing fluid flow through the well to create a pressure differential about at least one of the manipulator tool and the downhole tool such that the at least one of the manipulator tool and the downhole tool is lifted upwardly through the wellbore. A manipulator tool for use in a reverse circulating method is also described as are a tool catcher, a tool catching assembly and a tool catching method.

14 Claims, 5 Drawing Sheets

TOOLS AND METHODS USEFUL WITH WELLBORE REVERSE CIRCULATION

FIELD OF THE INVENTION

This invention relates to a tools and method for use in wellbore drilling and, in particular, tools and methods for wellbore operations using reverse circulation.

BACKGROUND OF THE INVENTION

Drilling with casing is gaining popularity as a method for drilling wherein the casing is used as the drill string and drilling conduit and, after drilling, the casing remains downhole to act as the wellbore liner. A drilling assembly, often including at least a drill bit and one or more hole enlargement tools such as, for example, an underreamer, is used which drills a borehole of sufficient diameter to accommodate the casing. The drilling assembly is deployed on the advancing end of the casing. The drilling assembly can be retractable and/or removable through the casing.

Drilling with casing has been tested for drilling vertical, straight and deviated wellbores.

Another form of drilling with casing is termed liner drilling. In liner drilling, the drilling assemblies operate and advance to extend the borehole while being mounted on the end of a section of liner. The liner is connected to surface by a length of drill pipe or additional casing.

When drilling with casing, it may be desirable from time to time during drilling and/or at the end of the drilling operation to retrieve the drilling assembly to surface. This is accomplished by tripping the drilling assembly up though the casing. Various tripping methods have been employed such as by running in pipe strings, wireline, coiled tubing, etc. to engage the drilling assembly and pull it to surface. Alternately, in other methods, a fluid conveyed dart may be used to manipulate the drilling assembly to release it from the drilling string so that the drilling assembly can be tripped to surface. By use of a dart, no rigid work string is required to be used to move the dart along even a deviated or horizontal drill string and circulation of drilling fluid can, if desired, continue during substantially the entire conveying and disengaging operation, with the exception of a short period during which the drill string is opened to introduce the dart. After manipulating the drilling string, a string may be used to pull the drilling assembly to surface. Thus, the dart may be connected to a line that is pulled behind the dart or may be free of any connection but a string is run in afterward to engage the drilling assembly and pull it to surface.

There is also interest in using reverse circulation move a drilling assembly to surface. The retrieval of a drilling assembly by reverse circulation proceeds wherein after the drilling assembly is disengaged from the drill string, drilling fluid is pumped down through the annulus between the drill string and the borehole to act against the drilling assembly and force it up through the drill string toward surface. Continued reverse circulation can lift the drilling assembly so that it can be retrieved at surface.

SUMMARY OF THE INVENTION

In accordance with a broad aspect of the present invention, there is provided a manipulator tool comprising: a body having an upper end and a lower end; a downwardly acting seal extending circumferentially about the body; and an actuator portion formed to manipulate a down hole tool, the tool being conveyable by fluid pressure acting against the downwardly acting seal.

In accordance with another broad aspect of the present invention, there is provided a method for reverse circulating a tool upwardly through a wellbore, the method including: providing a manipulator tool including an upper end and a lower end, conveying the manipulator tool down hole to a position adjacent a downhole tool, using the manipulator tool to manipulate the downhole tool, and reversing fluid flow through the well to create a pressure differential about at least one of the manipulator tool and the downhole tool such that the at least one of the manipulator tool and the downhole tool is lifted upwardly through the wellbore.

In accordance with another broad aspect of the present invention, there is provided a tool catcher to catch a tool approaching the tool catcher, the tool including a fluid passage therein and a seal in the fluid passage, the tool catcher comprising: a body including a secured end and an outboard end; engaging devices supported on the body, the engaging devices formed to act to resist passage therepast of a structure moving in a direction from the secured end towards the outboard end; and a stinger at the outboard end to open the seal of in the fluid passage of the tool.

In accordance with another broad aspect of the present invention, there is provided a tool catching assembly to catch a tool passing upwardly though a drill string, the tool including a fluid passage therein, a seal in the fluid passage and an engageable structure, the tool catching assembly comprising: a spear supported in a drill rig and formed to support and control fluid passage out of the drill string; and a tool catcher supported on the spear and positioned within the drill string, the tool catcher including a body including an end secured to the spear and an outboard end; engaging devices supported on the body, the engaging devices formed to act to resist passage therepast of the engageable portion of the tool moving in a direction from the secured end towards the outboard end; and a stinger at the outboard end to open the seal in the fluid passage of the tool.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1A:
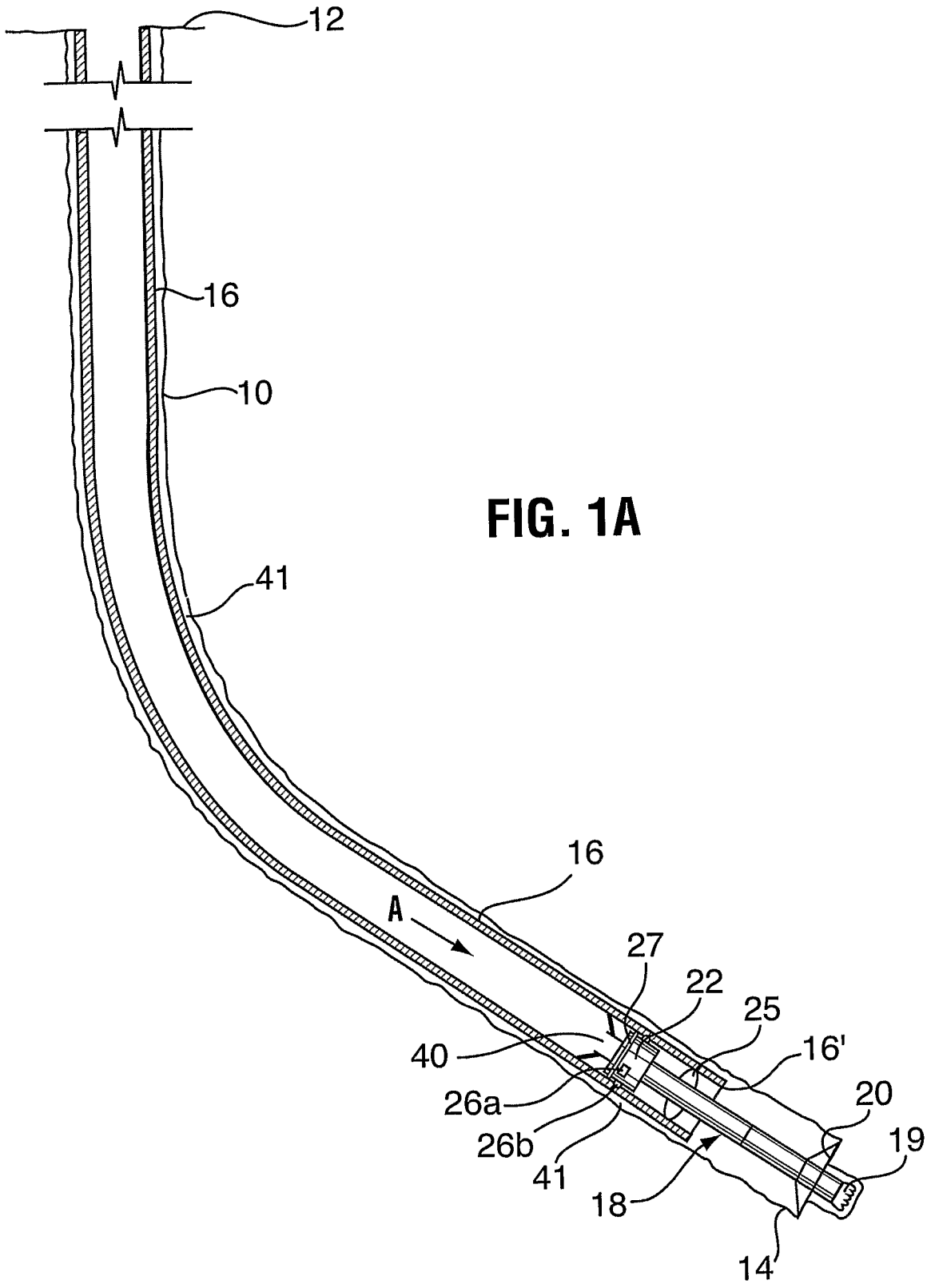
FIGS. 1A and 1B show sequential schematic vertical sections through a well illustrating a method for using reverse circulation to move a drilling assembly to surface.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, like parts are marked throughout the specification and the drawings with the same respective reference numerals. The drawings are not necessarily to scale and in some instances proportions may have been exaggerated in order more clearly to depict certain features.

The term casing is used herein to encompass any well bore liner capable of supporting an operational drilling assembly. In one aspect, the present invention provides a manipulator tool useful to manipulate a down hole tool such as, for example, in one embodiment may be a drilling assembly. In an operation using casing as a drill string, manipulation may, for example, be useful to release a drilling assembly from engagement with a casing drill string so that the drilling assembly can be tripped from its operational position in a well towards surface. A drilling assembly may be released to move through the casing string towards surface, for example for retrieval from the well bore, such as when drilling assembly maintenance is required or when drilling is complete.

A drilling assembly for use in drilling with casing may include a boring tool such as a drill bit, for example, which may include a pilot bit and underreamers. A drilling assembly may further include any of various devices including for example directional assemblies such as rotary steerable tools or downhole motors equipped with bent housings and/or bent subs; mud motors; measurement while drilling (MWD) or logging while drilling (LWD) instruments; stabilizers and other down hole tools.

As is known, drilling assemblies are attached to the drill strings in various ways such as, for example, by locking dogs latching in recesses in the casing. In one embodiment, a drilling assembly for drilling with casing may include a drill lock assembly that provides a mechanical attachment for the drilling assembly to the drill string and may engage into recesses in a portion of the drill string commonly called a profile nipple. The drill lock assembly may further provide a running and retrieval interface for the drilling assembly. Generally, the drill lock assembly may be positioned adjacent an upper end of the drilling assembly and may include any or all of an axial lock mechanism including lock dogs, a torque lock mechanism including lock dogs, a lock dog actuator, locators, retrieval portions, seals, etc.

A manipulator tool in the form of a release tool may be used to actuate the locking arrangement of the drilling assembly to be releasable from engagement with the drill string. A release tool may, for example, manipulate any of the axial and torque lock dogs that must be actuated to release the drilling assembly from engagement with the drill string. For example, the manipulator tool may act upon the lock dog actuator to drive the lock dogs, or permit them to be moved, out of engagement with their corresponding recesses in the profile nipple.

A manipulator tool may act on a down hole tool by various means, such as by abutment, mechanical engagement, hydraulic actuation, etc. or various combinations thereof.

In well bore drilling it may be useful to maintain fluid circulation through the well whenever possible, for example, even during periods in which the drill bit is not operating. Fluid circulation may act to condition the well, remove debris and prevent cave ins. Therefore, it may be useful to use a fluid conveyed tool (often called a "dart") as a manipulator tool for disengaging the drilling assembly from the drill string since such a tool permits circulation while being conveying down hole and may also permit fluid circulation during the actuation and sometimes the post-disengagement stages. If actuation of the drilling assembly to release from the drill string may be followed by reverse circulation, the disadvantages of stopping fluid circulation may be further reduced.

In one embodiment, a manipulator tool may be conveyed by fluid pressure, as by pumping down, and may be operated to manipulate a down hole tool by an increase in fluid pressure. Thereafter, the manipulator tool may be driven by reverse circulation to further manipulate the down hole tool and/or move the down hole tool toward surface.

Figure 1B:
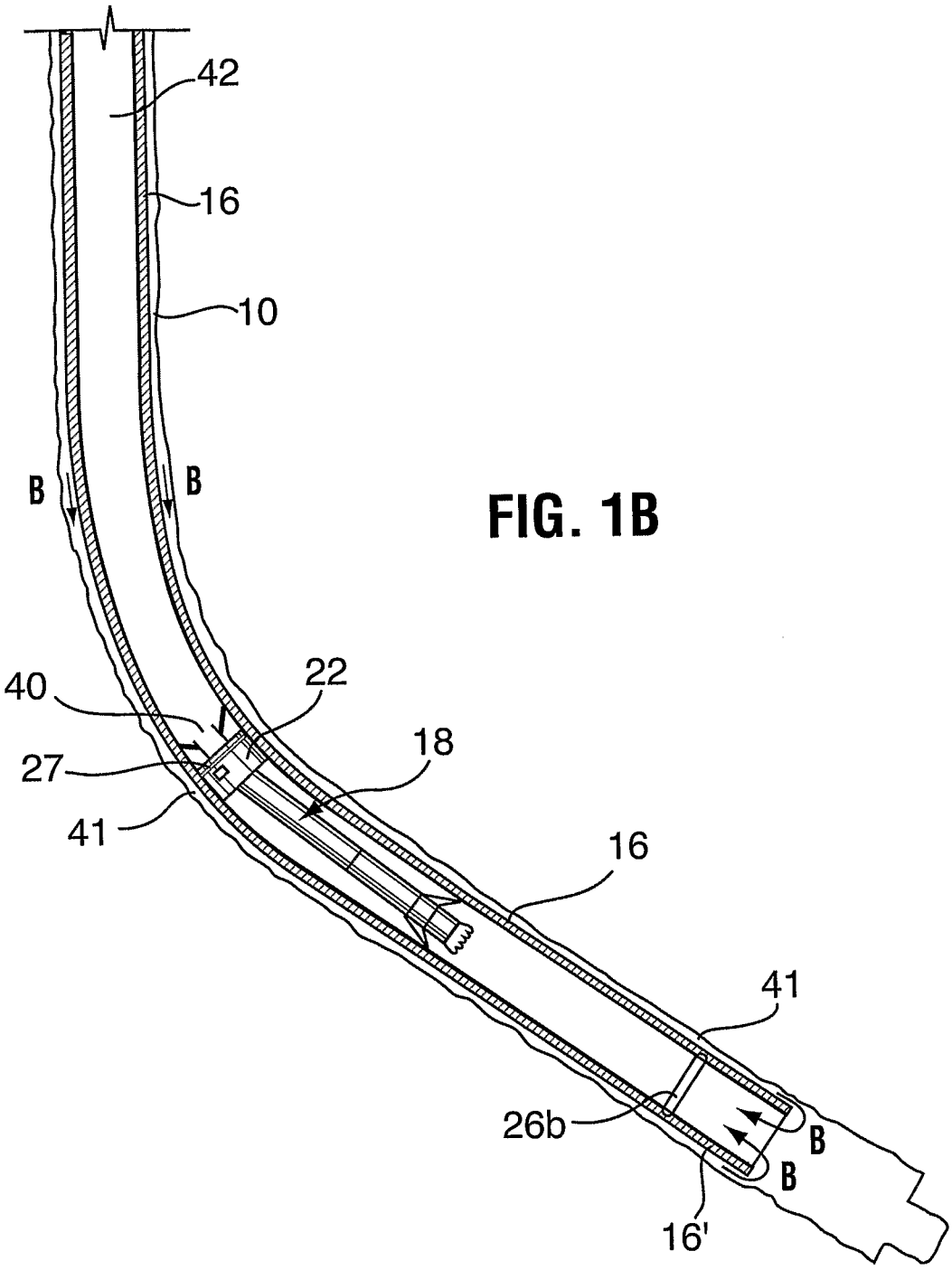

A process of retrieval of a drilling assembly 18 by reverse circulation is illustrated in FIGS. 1A and 1B. Referring to FIG. 1, a wellbore 10 is shown during a drilling operation. Wellbore 10 extends between surface 12 and bottom 11 of the wellbore. A drill string 16 formed of casing extends, in this embodiment, from surface into the wellbore. A drilling assembly 18 is connected at the distal end 16' of the drill string. Drilling assembly 18 includes a pilot bit 19, a plurality of underreamers 20, a drill lock member 22 for securing the drilling assembly to the drill string and a stabilizer 25. Of course, this is simply an example of numerous possible configurations for drilling assembly 18.

The well bore may be vertical, horizontal or deviated, as shown, with a curved trajectory. When drilling with casing, as shown, the drill string may be left in the well after drilling to line the well bore. Drilling assembly 18 drills the well by rotation of the string from surface, by use of a down hole motor driven by various means including air, mud, electrical, etc. Periodically during drilling or at the end of the drilling procedure, assembly 18 may be tripped to surface for repair or reuse. In so doing, the under reamers 20 may be collapsed to fit through the drift of the drill string.

Drilling assembly 18 is connected into drill string 16 for example by means of lock dogs 26*a* on drill lock member 22 that latch into profile recesses 26*b* in the string. As will be appreciated by a person skilled in the art, the lock dogs may be unlocked so that they can be moved, or activated to retract, out of engagement with recesses 26*b* by manipulation of member 22. Member 22 can be manipulated by a manipulator tool 40, also termed a release tool. As is known, manipulator tool 40 manipulates member 22 such as, for example, by driving a latch to retract out of engagement with drill string 16, by actuating a lock mechanism to allow the lock dog to be collapsed out of engagement with the drill string, etc. Such an action can be achieved in various ways and by various interacting mechanisms. Generally, for well control drill lock member 22 may be limited to unlocking only by use of a manipulation tool. For example, it may be desirable to avoid the use of release systems that cause the member 22 to release automatically from engagement from the drill string in response to fluid pressures without the manipulator tool present.

Once the drilling assembly is released from the drill string, the manipulator tool and drilling assembly may be tripped toward surface.

Tool 40 may for convenience be fluid conveyed. Manipulator tool 40 may be introduced to the drill string by opening briefly the surface well head and may be pumped with drilling fluid circulation downhole. In such an embodiment, manipulator tool 40 includes a seal thereabout that holds pressure above the tool and causes the manipulator tool to be conveyed by fluid flow along arrows A into engagement with the drilling assembly.

In the illustrated embodiment of FIG. 1A, fluid-conveyed manipulator tool 40 is shown in an actuating position, landed on and partially inserted into member 22. As will be appreciated, the manipulator tool can be, for example, formed, for example at its leading, lower end, to act against and depress shoulders, or engage and pull on release mechanisms, of member 22 that in turn cause the disengagement of the locking dogs on member 22 from drill string 16. Alternately, manipulator tool 40 may be configured to open member 22 to the effects of fluid pressures such that the member can then be driven by hydraulics to disengage from the drill string.

By use of a fluid conveyed manipulator tool 40, no work string is required to be used and circulation of drilling fluid can, if desired, continue during substantially the entire conveying and disengaging operation, with the exception of a short period during which the drill string is opened to introduce the tool.

In the illustrated embodiment of FIG. 1B, the retrieval of manipulator tool and drilling assembly 18 is shown by reverse circulation wherein after the drilling assembly is disengaged by operation of the manipulator tool from drill string 16, drilling fluid is pumped down, arrows B, through the annulus 41 between drill string 16 and borehole 10 to act against the drilling assembly and/or the manipulator tool and force them both up through the drill string toward surface. Continued reverse circulation can, if desired, lift the manipulator tool and drilling assembly so that they can be retrieved at surface. If undesirable annulus pressures are required to lift the drilling assembly through the drill string, it may be useful to reduce the fluid pressure in the string above the drilling assembly, in the area indicated by 42, as by, for example, creating suction, replacing the fluid in the string above the drilling assembly with a relatively lighter fluid, or otherwise reducing the hydrostatic head within the string.

Drilling assembly 18 may, as shown, include seals 27, valves, etc. selected to seal against and hold pressure during reverse circulation such that reverse circulation may move the drilling assembly and possibly anything connected above it, such as manipulator tool 40, toward surface. Alternately or in addition, the manipulator tool may include an external annular seal and/or a through bore seal (see FIGS. 2 and 3) such that the manipulator tool seals against and holds pressure during reverse circulation such that reverse circulation may move the manipulator tool and possibly the drilling assembly attached thereto toward surface. In one embodiment, for example, the manipulator tool during its manipulation operations at least in part opens a fluid bypass around a seal on the drilling assembly such that fluid pressure can be communicated to a downwardly acting seal on the tool so that reverse circulation can lift the tool and the drilling assembly engaged by the tool upwardly through the drill string.

Figure 2:
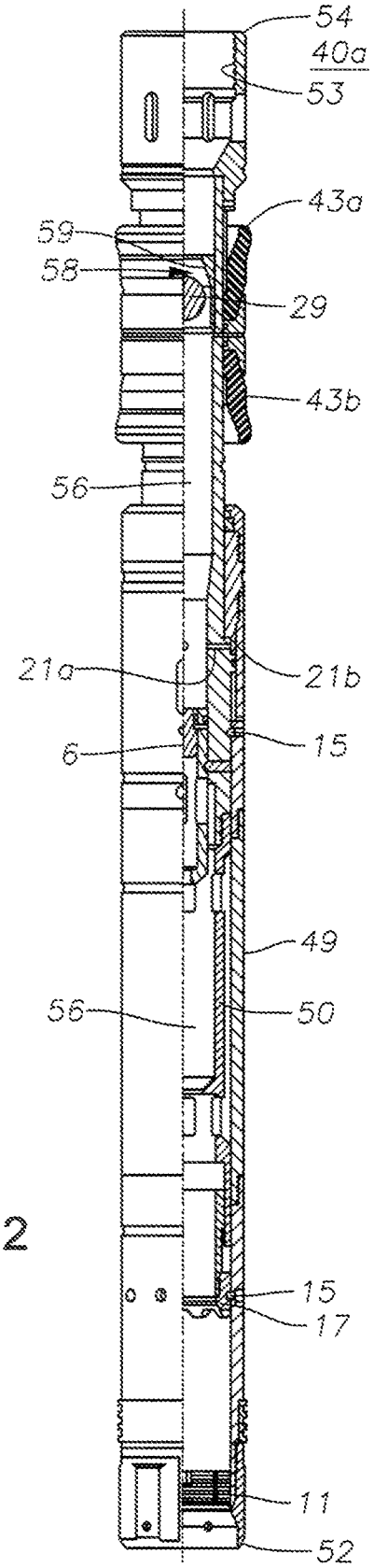
FIG. 2 is a quarter sectional view through a manipulator tool according to one aspect of the present invention.
Figure 3:
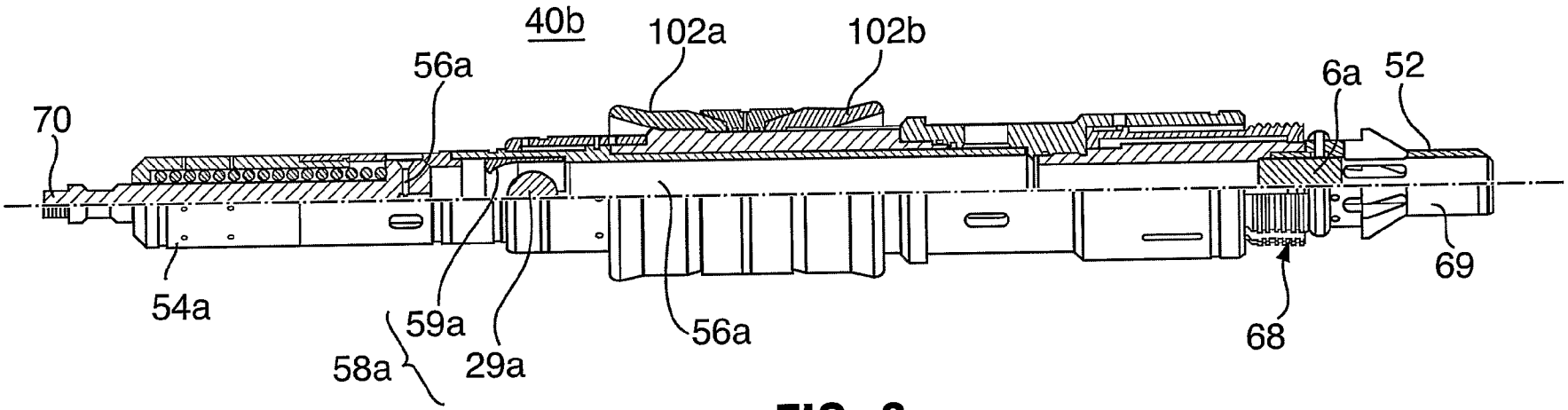
FIG. 3 is quarter sectional view through another manipulator tool according to an aspect of the present invention.

FIG. 2 shows a long axial section through one embodiment of a manipulator tool 40*a* useful in a method of releasing a drilling assembly from the drill string and tripping the drilling assembly to surface by reverse circulation. Manipulator tool 40*a* includes a body including an annular seal 43*a* thereabout that is selected to act between the manipulator tool body and the drill string to create an annular seal therebetween when the tool is positioned in the drill string. Seal 43*a*, formed in this embodiment as an upwardly facing packer cup, provides that manipulator tool 40*a* can be pumped through a drill string by pressure acting against seal 43*a*. Manipulator tool 40*a* further includes an actuator portion that is formed, with consideration to the downhole tool to be actuated, to act with that tool and the nature of the manipulation action that is required for that down hole tool. In the illustrated embodiment, for example, the tool includes a lower end 52 including a grapple 11, a hydraulically driven sleeve 49 and a mandrel 50 with a stop end 17 (and related components including shear pins 15, etc.).

Manipulator tool 40*a* further may include a fluid passage system. The fluid passage system includes a bore 56 through the mandrel and the sleeve from the tool's upper end 54 to its lower end 52. Bore 56 may permit fluid to flow through the manipulator tool downwardly from the upper end to the lower end, which may be useful for example when circulating after a manipulation operation. In one embodiment, it may be desirable that bore 56 be closed during certain operations, such as during pumping down and possibly, as in the present embodiment, during and/or for actuation by the actuator portion but to be opened at certain selected periods. In one such embodiment, bore 56 may include a plug 6 that normally seals bore 56 against fluid flow therethrough but may be removed, as by shearing out, when desired, for example to permit fluid passage through the bore.

In the illustrated embodiment, the fluid passage system further includes a check valve 58 in bore 56, including in the illustrated embodiment a ball 29 and seat 59, that closes during reverse fluid flow, in a direction from lower end 52 to upper end 54. As such, reverse flow may be stopped through the tool so that a pressure differential may form where fluid pressure above the tool is less than fluid pressure below it.

A further annular seal 43*b* may be provided below seal 43*a* to act to create a seal between the manipulator tool body and the drill string to create a seal when positioned in the drill string. Seal 43*b*, formed in this embodiment as an downwardly facing packer cup, provides that manipulator tool 40*a* can maintain, and thereby be lifted through the drill string by, a pressure differential created between upper end 54 of the manipulator tool and its lower end 52 during reverse circulation. Of course, the operability of seals 43*a* and 43*b* can be combined in a single sealing structure, if desired.

Figure 2A:
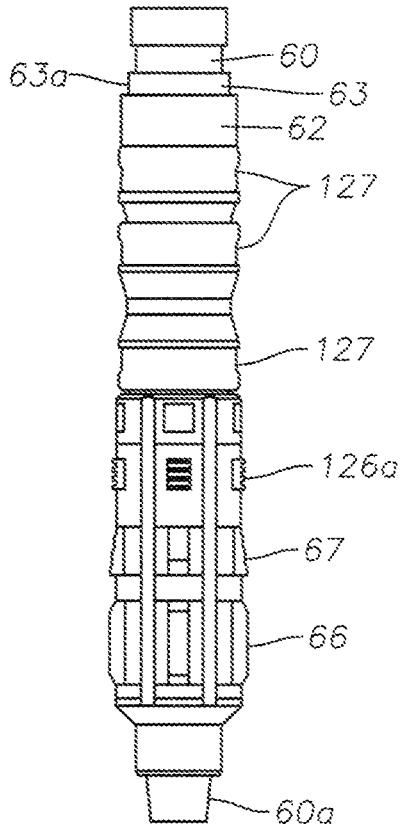
FIG. 2A is a side elevation of a drill lock assembly useful in the present invention.

The tool of FIG. 2 may be used in a method similar to that shown in FIG. 1 wherein the tool is conveyed downhole as by the provision of seal 43*a*, in the illustrated embodiment downhole conveyance may be facilitated by the use of plug 6 to close bore 56 during the pump down procedure. A drilling assembly is manipulated by tool 40*a* to be disengaged from the drill string, as by use of grapples 11 to engage a lock mechanism on the drilling assembly and actuation of sleeve 49 over mandrel 50 by pressuring up to apply fluid pressure against a piston arrangement including port 21*a* from bore 56 and piston face 21*b*. In so doing, shear screws 15 may shear to allow the sleeve to travel over the mandrel. In particular, the illustrated tool is configured to act upon a drill lock assembly, such as one shown in FIG. 2A available by TESCO Corporation, which includes an inner mandrel 60 to which a drill bit and other drilling assembly components may be attached at lower end 60*a*, an outer housing 62 carrying annular seals 127 and axial lock dogs 126*a* and an intermediate lock sleeve 63, commonly termed a cone mandrel, substantially concentrically positioned between the inner mandrel and the outer housing. In operation to lock a drill lock assembly in a casing profile nipple, the inner mandrel and the intermediate lock sleeve are locked together, the axial lock dogs are positioned in their recess in the casing and the intermediate lock sleeve is positioned behind the axial lock dogs to prevent them from collapsing out of their casing recess. Tool 40*a* may manipulate such a drill lock assembly in a number of ways, for example, by first landing against the drill lock assembly wherein lower end 52 abuts against the drill lock assembly and releases the inner mandrel from engagement with the intermediate lock sleeve. Thereafter, grapples 11 engage an outer surface 63*a* of the intermediate lock sleeve, while the tool passes over the inner mandrel such that stop end 17 butts against an upper end of the inner mandrel. The casing string can then be pressured up such that, while the tool mandrel 50 is held against the inner mandrel of the drill lock assembly, fluid acts against piston face 21*b* to shear pins 15 and move sleeve 19 upwardly over the tool mandrel 10. This movement of sleeve 19 draws the intermediate lock sleeve, to which it is engaged by grapples 11, upwardly from between the inner mandrel and the outer housing. Such movement results in the intermediate lock sleeve being removed from behind the axial lock dogs such that they are able to be collapsed out of engagement with their profile nipple recess, allowing the drill lock assembly to be moved axially within the casing string, if desired. In such a drill lock assembly, the torque lock dogs 66 and locators 67 may only be biased, but not locked, outwardly such that when the axial lock dogs can collapse out of engagement with their recesses, the torque lock dogs and locators 67 can be moved against their biasing force to also move out of their recesses. In a drill lock assembly as described, the intermediate lock sleeve may also act as a valve to regulate fluid flow around the drill lock assembly seals 127. Upward movement of the sleeve may open ports to allow fluid bypass around the drill lock seals.

Thereafter, plug 6 may be sheared out to permit bypass of fluid through tool 40*a* to the drilling assembly for well bore circulation. The tool further assists in tripping the tool itself and the drilling assembly engaged thereby, for example by grapples 11, to surface by operation of seal 43*b* and check valve 58 when drilling fluid is reverse circulated through the well.

Although the foregoing has described a manipulator tool in the form of a release tool for releasing a drilling assembly from engagement with the drill string, a manipulator tool of the present invention may be used for various downhole operations such as setting a device such as a packer or a bridge plug. For example, with reference to FIG. 3 a wireline pulling tool 40*b* is shown for manipulating a down hole tool by applying a pulling action thereto, but may or may not be intended for retrieving a tool entirely to surface. Wireline pulling tool 40*b* may include a body including a seal 102*a* selected to act against fluid flow therepast from above, a seal 102*b* selected to act against fluid flow therepast from below for use in conveying the tool by reverse circulation, an actuator portion including grapples 68 for engaging a downhole tool and transmitting a pulling force to a downhole tool, a stinger 69 for opening a valve to create a fluid passage through the tool and a fluid passage system including, for example, a bore 56*a* through the tool to permit, when open, fluid flow communication between its upper end 54*a* and its lower end 52*a*, a shearable plug 6*a* in bore 56*a* and a check valve 58*a*, including a seat 59*a* and ball 29*a*, in bore 56*a* that closes during fluid flow in reverse, which is in a direction from lower end 52*a* to upper end 54*a*.

Although tool 40*b* can be conveyed down hole by fluid pressure and retrieved to surface by reverse circulation acting against seal 102*b* and check valve 58*a*, tool 40*b* further includes a wireline connection 70 that permits attachment of a wireline thereto such that an additional pulling action may be applied to tool 40*b* and/or any tool being manipulated by tool 40*b*, as desired or necessary.

When drilling with a system where tools are retrieved to surface, there is often a limit to the length of the well bore in which such tools can be operated since it becomes difficult to trip the tools entirely to surface. For example, if the tools are to be retrieved with wireline, long wireline lengths limit the pull force that can be applied therethrough. Such limited pull force may be insufficient to release the tool from its mounted position at the lower end of the casing. Alternately, if reverse circulation is used to retrieve the tools, the pressures required to do so may be difficult to maintain. Thus, in one embodiment, a method for retrieving tools through a liner string may be provided wherein a manipulator tool is engaged by a wireline and reverse circulation is used alone or in combination with the wireline pull force to manipulate a downhole tool and/or release a downhole tool from its mounted position in a well. Thereafter, the wireline, alone or in combination with reverse circulation, may be used to trip the tools to surface. The reverse circulation may be used, for example, to convey the tools up hole a distance before the wireline is used to begin pulling. The down hole tool may be released by action of the reverse circulation provided by manipulator tool 40*b* or such release may require other manipulation, as by use of push or pull force.

Alternatively, in order to retrieve the manipulator tool, a tool catcher may be used. The tool catcher engages the tool being lifted such as the manipulator tool so as to prevent it from falling down the well and may ensure that the manipulator tool lands in a controlled manner, for example with a means for release of fluid pressure from below the tool, when the manipulator tool reaches the top of the well bore.

A tool catcher may be formed and configured to catch a tool approaching the tool catcher, the tool including a fluid passage therein and a seal in the fluid passage blocking flow therethrough. The tool catcher may include a body including a secured end and an outboard end, engaging devices supported on the body and a stinger. The engaging devices may be formed to allow passage of an engagable portion of the tool thereover in a direction from the outboard end to the secured end but may be formed to act to resist passage therepast of a portion of the tool moving in a direction from the secured end towards the outboard end. As such, the tool, as it approaches the catcher, may pass over the catcher engaging devices but cannot be withdrawn therefrom. The engageable portion of the tool and the engaging devices may take various forms to interengage and resist relative movement therebetween. For example, these parts may include teeth, a shoulder, collet fingers, etc. on either the tool or the tool catcher. The stinger may be positioned at the outboard end to open the seal in the fluid passage of the tool to permit any pressure in the fluid passage to be dissipated. The stinger may be formed to break a seal, shear out a plug, open a valve, etc. A stinger may be in the form of an extension, rod, protrusion, etc.

Figure 4:
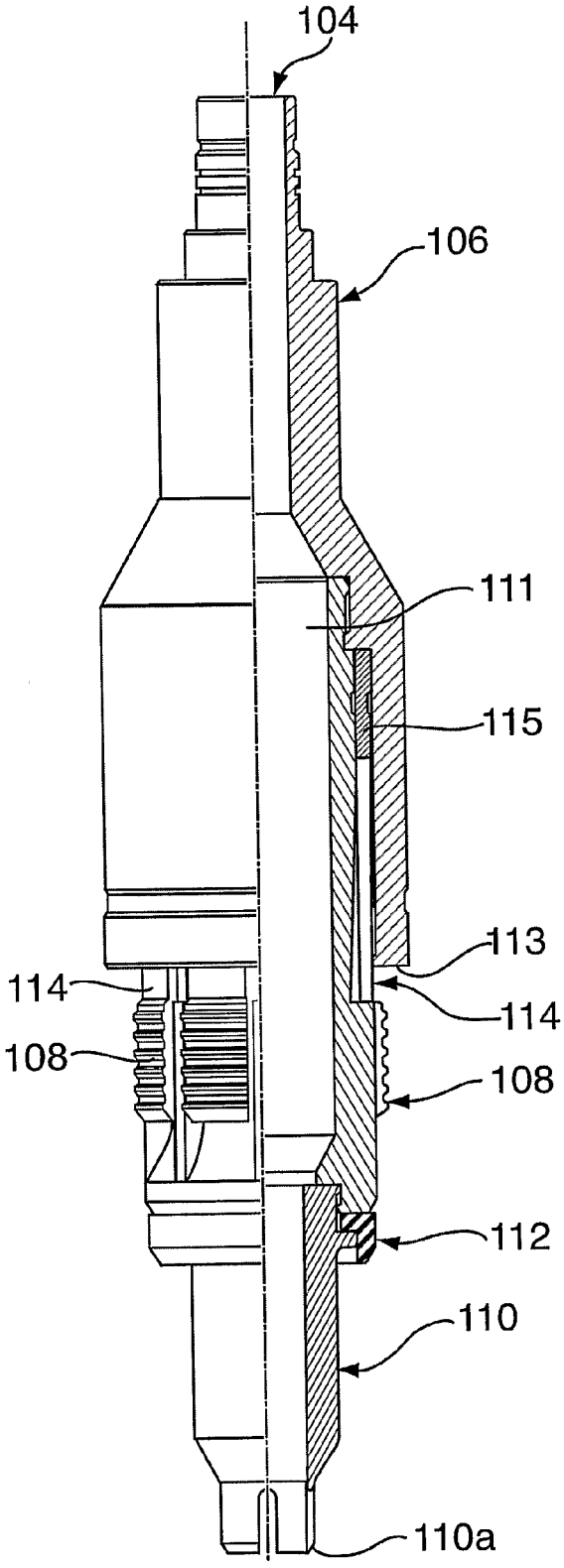
FIG. 4 is a quarter sectional view through a tool catcher according to an aspect of the present invention.

With reference to FIG. 4, a tool catcher 104 is shown according to one embodiment. A tool catcher 104, as shown, may operate with a tool that is conveyed uphole by reverse circulation such as manipulator tool 40*a* of FIG. 2. Tool catcher 104 may comprise a housing 106 which includes engaging devices such as teeth 108, which engage corresponding teeth, such as teeth 53, on the manipulator tool and a stinger 110, which extends down from the body of the catcher tool. Lowermost end 110*a* of stinger 110 is spaced from teeth 108, with consideration of the dimensions of the tool to be caught, such that, for example with reference to the tool FIG. 2, when the tool catcher teeth 108 engage the manipulator tool teeth 53, stinger 110 extends into the upper end of the manipulator tool and is positioned to open a check valve, for example check valve 58. In the illustrated embodiment, stinger 110 is formed to displace ball 29 from its seat 59 to open bore 56. This releases the pressure from below the check valve of the manipulator tool and helps ensure that the manipulator tool lands softly against the catcher. In addition, the fluids released by opening the check valve can be monitored to determine if any hydrocarbon fluids have been circulated to the inner bore of the drill string and to allow the well to be circulated in reverse before opening the interior of the drill string to atmosphere. Catcher 104 may include an inner bore 111 extending up past or through stinger 110 to the upper end of the catcher to allow fluid passage therethrough.

Even after the valve is opened to release pressure from below the reverse circulated tool, the body of the tool may have the momentum to continue upwardly. The tool catcher may therefore include a stop, such as surface 113, or other shoulders or ledges positioned variously on the tool and/or a shock absorber for slowing and stopping advancement of the tool. The shock absorber may include, for example, an elastomeric stop 112, for example of rubber or other polymers, positioned to be contacted by the body of manipulator tool, for example, at the upper end of the stinger, as shown, on lowermost end 110*a*, or above teeth 108. The rubber stop cushions the impact of the engagement of the manipulator tool against the tool catcher. Alternately, there may other shock absorbers to cushion the impact of the manipulator tool against the tool catcher, such as, for example, springs, hydraulic shock absorbers, etc. Of course, the shock absorber.

In FIG. 4, teeth 108 of the catcher, as illustrated, are positioned to be engaged on the inside of the manipulator tool. However, the teeth may alternately be positioned to engage against the outside of the tool, if desired. In the illustrated embodiment, teeth 108 are installed to be biased out into engagement with the manipulator tool but are compressible to allow passage of the manipulator tool over the teeth. For example, teeth 108 are positioned on fingers 114 of a collet 115. Of course, other means of installation may be used. For example, in such embodiments, the teeth could be rigid and ramped, as in a ratchet arrangement.

A catcher may be installed in the well bore in various ways to catch a tool conveyed by reverse circulation. For example, the catcher may be installed on a wellhead apparatus. In another embodiment, the catcher may be positioned to catch a tool by installation on a spear that also supports the drill string and controls fluid passage out of the upper end of the drill string, generally without reliance on a threaded connection to the drill string. The spear may be a portion of a tubular gripping device. Tubular gripping devices can vary significantly in form and function. Tubular gripping devices may operate without reliance on threaded connections and may often include an internal and/or external tubular gripping mechanism. Unlike connections effected by threaded connections, tubular gripping devices can operate without requiring significant relative rotational movement, between the gripping device and the item to be gripped. Gripping devices may include packer-type systems that expand to grip an inner or an outer diameter of the tubular to be gripped. Tubular gripping mechanisms may alternately or in addition include teethed dies that can be driven to grip and bite into the tubular. These gripping mechanisms may be driven mechanically, hydraulically, by motors, etc. Generally, gripping mechanisms driven by hydraulics can be operated quickly and without requiring significant movement of the tool on which the mechanism is mounted. Some gripping devices for casing-type tubulars, for example, are described in U.S. Pat. No. 6,311,792, issued November 2001 (an external casing gripping device) and International application WO00/05483, published February 2000 (an internal casing gripping device), both to TESCO Corporation.

Figure 5:
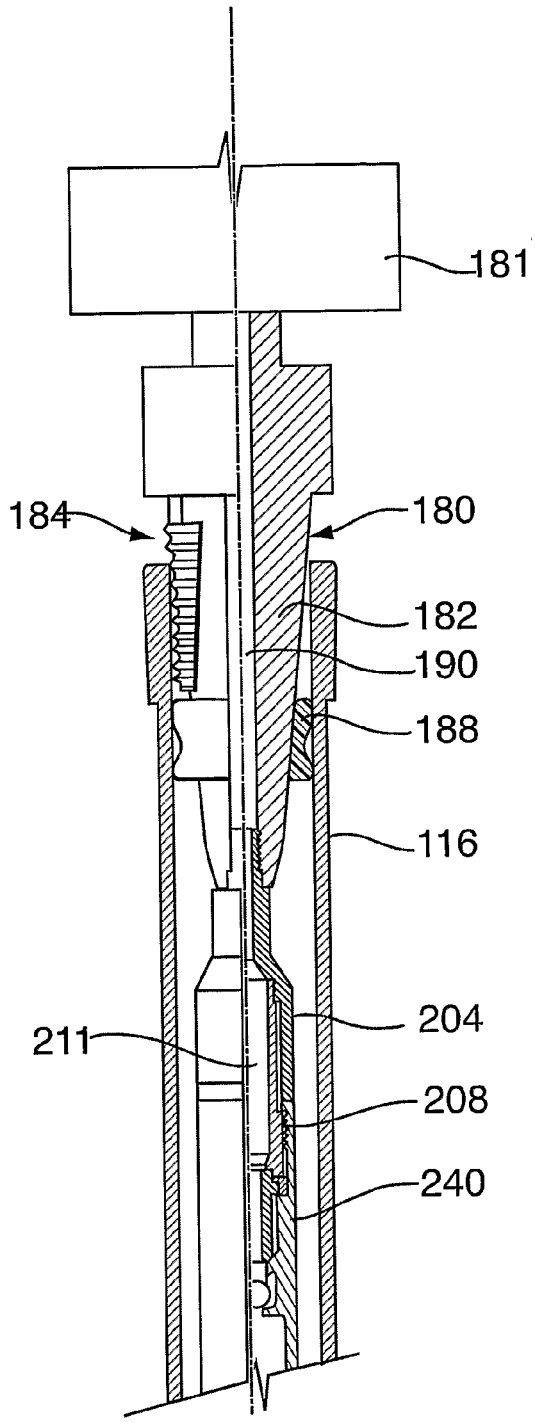
FIG. 5 is a schematic view of a catcher assembly according to an aspect of the present invention.

With reference to FIG. 5, a catching assembly is shown including a catcher 204 threadedly connected to a tubular gripping device 180 and in position in a casing string 116 to catch a manipulator tool 240 moved by reverse circulation into engagement with the catcher. Tubular gripping device 180 may be supported in a rig on a top drive 181 and may be configured and constructed to support the weight of, and possibly reciprocate and/or rotate, the casing string and to permit circulation therethrough. For example, tubular gripping device 180 may include a spear 182 for insertion into the upper end of the casing string 116. Although outer gripping devices are known, in the presently illustrated device spear 182 carries a hydraulically driven gripping mechanism, indicated generally at 184, including toothed dies drivable to internally grip and support the upper end of casing string 116. Tubular gripping device 180 may also include an annular seal 188 to seal between the spear and the inner diameter of the casing string to prevent against fluid passing therebetween and a fluid passage 190 therethrough to accommodate fluid flow therethrough. In such an embodiment, catcher 204 may be threaded onto a lower end of spear 182, for example, in the place of a nose cone normally installed thereon such that teeth 208 are exposed for engagement of manipulator tool 240 and bore 211 may be in communication with bore 190.

After a tool is caught on catcher 204, fluid circulation may be continued through the tool, the catcher and device 180. When it is desired to retrieve tool 240, casing string 116 may be supported in the rig floor and spear 182 can be disengaged and withdrawn from the upper end of string 116. In so doing, catcher 204 and tool 240 are withdrawn with spear 182. Tool 240 may be a reverse circulated manipulator tool, a reverse circulated drilling assembly or other reverse circulated tool.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The embodiments of the invention in which an exclusive property or privilege is claimed are defined as follows:

1. An apparatus for performing an operation within a wellbore with a tubular string, comprising:

a tubular member having an internal profile recess adapted to be connected into the tubular string;

a downhole tool having a lock dog that releasably latches to the internal profile while the downhole tool is in an engaged position;

a manipulator tool having an upper end and a lower end;

a fluid passage system including a bore providing a fluid passage through the manipulator tool to provide communication between the upper end and the lower end;

a barrier in the bore of the manipulator tool that blocks downward flow through the bore, and is movable to open the bore to downward flow in response to a downward directed pressure differential above a selected level;

an upward-facing cup seal extending circumferentially about the manipulator tool for sealingly engaging the tubular string, the upward-facing cup seal and the barrier enabling the manipulator tool to be pumped down the tubular string into engagement with the downhole tool;

a grapple on the manipulator tool that secures the manipulator tool to the downhole tool when the manipulator tool engages the downhole tool;

an actuator portion within the manipulator tool to release the lock dog of the downhole tool from engagement with the internal profile recess of the tubular member in response to downward fluid pressure below the selected level, which moves the grapple when the manipulator tool is in engagement with the downhole tool;

a valve in the bore that blocks upward fluid flow in the bore after the barrier has moved to open the bore; and a downhole-facing cup seal on the manipulator tool, the downward-facing cup seal and the valve enabling the downhole tool to be lifted in the tubular string by the upward fluid flow in the tubular string after the manipulator tool has released the latch dog from engagement with the internal profile recess.

2. The apparatus of claim 1 wherein the actuator portion includes a mechanism for driving relative movement of parts of the downhole tool.

3. The apparatus of claim 1, wherein the barrier comprises a shearable plug.

4. The apparatus of claim 1 wherein the actuator portion includes a piston arrangement for applying a force to the downhole tool in response to fluid pressure applied to an interior of the tubular string from above the manipulator tool after the manipulator tool has engaged the downhole tool.

5. The apparatus of claim 1 wherein the manipulator tool is a release tool for a drill lock assembly, the drill lock assembly comprising the downhole tool.

6. A method for performing an operation within a wellbore, the method including:

latching a downhole tool within a lower portion of a pipe string and deploying the pipe string within a wellbore; then circulating fluid down the pipe string through the downhole tool and performing operations in the wellbore with the downhole tool;

providing a manipulator tool including an upper end and a lower end;

to retrieve the downhole tool, pumping the manipulator tool down the pipe string to a position in engagement with the downhole tool by pumping fluid in a downward direction down the pipe string;

applying downward directed fluid pressure to cause the manipulator tool to release the downhole tool from latching engagement with the pipe string; and after the downhole tool has released from latching engagement with the pipe string, flowing fluid down the wellbore around the pipe string in reverse circulation to create an upward directed pressure differential about at least one of the manipulator tool and the downhole tool such that the downhole tool and the manipulator tool are lifted up the pipe string;

providing the manipulator tool with a flow passage extending from the upper end to the lower end of the manipulator tool;

placing a barrier in the flow passage that has a closed position that blocks upward and downward flow through the flow passage and a released position, allowing upward and downward flow through the flow passage;

placing a check valve in the flow passage that allows downward flow in the flow passage but blocks upward flow in the flow passage; wherein the barrier is in the closed position while the manipulator tool is pumped down the pipe string and moves to the released position in response to increased downward fluid pressure after the manipulator tool has engaged the downhole tool; and the upward directed pressure differential acts against the check valve.

7. The method of claim 6 wherein the manipulator tool has an external downward-facing conical seal that slidingly engages an interior of the pipe string, and while in reverse circulation, the fluid acts against the downward-facing seal to apply a lifting force to the manipulator tool.

8. The method of claim 6 wherein the manipulator tool has a mandrel located within a sleeve, and releasing the downhole tool comprises moving the sleeve and mandrel axially relative to one another.

9. The method of claim 6 wherein the manipulator tool includes an external upward-facing conical seal thereabout which the downward directed fluid pressure is applied.

10. The method of claim 6 wherein the pipe string comprises a casing string.

11. A tool for releasing a drill lock assembly ("DLA") from locking engagement with a casing string, comprising:

a sleeve having a longitudinal axis;

a mandrel carried in the sleeve, the mandrel having a bore therethrough;

an upward-facing cup seal surrounding the sleeve to engage an interior of the casing string;

a shearable plug in the bore that shears at a selected shear differential pressure, the shearable plug and the upward-facing cup seal enabling the tool to be conveyed down the casing string into engagement with the DLA in response to differential fluid pressure applied to the upward-facing cup seal and the shearable plug at a level less than the selected shear differential pressure;

the sleeve and the mandrel being axially movable relative to each other after engaging the DLA in response to continued differential fluid pressure at a level less than the selected shear differential pressure applied to the upward-facing cup seal and the shearable plug;

a grapple adapted to engage a portion of the DLA, the grapple being movable in response to the relative axial movement of the mandrel and the sleeve to release the DLA from locking engagement with the casing string;

a downward-facing cup seal surrounding the sleeve to engage the interior of the casing string;

a check valve in the bore that allows downward flow of fluid and blocks upward flow of fluid through the bore, the downward-facing cup seal and the check valve enabling the tool and the DLA to be conveyed up the casing string by reverse circulation of fluid in the casing string after the DLA is released and the shearable plug sheared, by applying a differential pressure to the downward-facing cup seal and the check valve.

12. The tool of claim 11, wherein;

the check valve is located above the shearable plug.

13. A method for performing an operation within a wellbore, the method including:

latching a downhole tool within a lower portion of a pipe string and deploying the pipe string within a wellbore; then circulating fluid down the pipe string through the downhole tool and performing operations in the wellbore with the downhole tool;

providing a manipulator tool including an upper end and a lower end;

to retrieve the downhole tool, pumping the manipulator tool down the pipe string to a position in engagement with the downhole tool by pumping fluid in a downward direction down the pipe string;

applying downward directed fluid pressure to cause the manipulator tool to release the downhole tool from latching engagement with the pipe string; and after the downhole tool has released from latching engagement with the pipe string, flowing fluid down the wellbore around the pipe string in reverse circulation to create an upward directed pressure differential about at least one of the manipulator tool and the downhole tool such that the downhole tool and the manipulator tool are lifted up the pipe string;

wherein the manipulator tool has an external downward-facing conical seal that slidingly engages an interior of the pipe string, and while in reverse circulation, the fluid acts against the downward-facing seal to apply a lifting force to the manipulator tool.

14. A method for performing an operation within a wellbore, the method including:

latching a downhole tool within a lower portion of a pipe string and deploying the pipe string within a wellbore; then circulating fluid down the pipe string through the downhole tool and performing operations in the wellbore with the downhole tool;

providing a manipulator tool including an upper end and a lower end;

to retrieve the downhole tool, pumping the manipulator tool down the pipe string to a position in engagement with the downhole tool by pumping fluid in a downward direction down the pipe string;

applying downward directed fluid pressure to cause the manipulator tool to release the downhole tool from latching engagement with the pipe string; and after the downhole tool has released from latching engagement with the pipe string, flowing fluid down the wellbore around the pipe string in reverse circulation to create an upward directed pressure differential about at least one of the manipulator tool and the downhole tool such that the downhole tool and the manipulator tool are lifted up the pipe string;

wherein the manipulator tool has a mandrel located within a sleeve, and releasing the downhole tool comprises moving the sleeve and mandrel axially relative to one another.

* * * * *